US006668500B1

(12) United States Patent
Lamberts

(10) Patent No.: US 6,668,500 B1
(45) Date of Patent: Dec. 30, 2003

(54) HOLDING RAIL FOR HOLDING GLASS PROFILE ELEMENTS

(75) Inventor: Christoph Lamberts, Wunsiedel (DE)

(73) Assignee: Glasfabrik Lamberts GmbH & Co. KG, Wunsiedel (DE)

( * ) Notice: Subject to any disclaimer, the term of this patent is extended or adjusted under 35 U.S.C. 154(b) by 0 days.

(21) Appl. No.: 09/744,757

(22) PCT Filed: May 26, 2000

(86) PCT No.: PCT/DE00/01709

§ 371 (c)(1),
(2), (4) Date: Mar. 6, 2001

(87) PCT Pub. No.: WO00/75452

PCT Pub. Date: Dec. 14, 2000

(30) Foreign Application Priority Data

May 26, 1999 (DE) ..... 299 09 184 U
Aug. 25, 1999 (DE) ..... 299 14 926 U

(51) Int. Cl.[7] ..... E06B 3/988

(52) U.S. Cl. ..... 52/204.72; 52/204.62; 52/208; 52/204.6; 49/504; 49/505

(58) Field of Search ..... 52/204.61, 456, 52/204.62, 235, 213, 208, 209, 204.71, 204.72, 307, 308, 204.591, 204.593, 204.6; 49/504, 505

(56) References Cited

U.S. PATENT DOCUMENTS 4,015,388 A * 4/1977 Hemminger ..... 52/395
4,461,133 A * 7/1984 Laroche ..... 52/730.1
4,644,717 A * 2/1987 Biebuyck ..... 52/209
4,961,553 A * 10/1990 Todd ..... 248/62
4,982,530 A * 1/1991 Palmer ..... 49/504
5,195,569 A * 3/1993 Peterson et al. ..... 160/84.1
5,212,922 A * 5/1993 Werner ..... 52/235
5,653,073 A * 8/1997 Palmer ..... 52/204.593
5,806,256 A * 9/1998 Byrne ..... 52/204.5
5,921,037 A * 7/1999 Minter ..... 52/204.5
6,055,783 A * 5/2000 Guhl et al. ..... 52/204.62
6,145,256 A * 11/2000 Cittadini et al. ..... 52/204.7
6,293,049 B1 * 9/2001 Shaw ..... 49/183
6,401,428 B1 * 6/2002 Glover et al. ..... 52/786.13

FOREIGN PATENT DOCUMENTS

EP 0 261 907 A2 * 3/1988 ..... 52/730.1
EP 0 931 635 A1 * 7/1999 ..... 52/730.1
WO 02/090702 A1 * 3/1999 ..... 52/730.1
WO 99/14169 * 3/1999 ..... 52/235

* cited by examiner

*Primary Examiner*—Lanna Mai
*Assistant Examiner*—Dennis L. Dorsey
(74) *Attorney, Agent, or Firm*—Max Fogiel

(57) ABSTRACT

The invention relates to a holding device for holding glass closures (20) formed by individual glass profile elements, especially U-shaped glass profile elements (21, 21'), or other long glass elements, especially insulating glass elements. In order to prevent water condensation inside the glass closure (20), the holding device comprises at least one holding rail (2; 32, 36, 37; 34, 64, 65; 34, 64', 76; 79; 80) for holding or mounting and for laterally guiding and supporting the individual long glass elements or glass profile elements (21, 21') or the glass closure (20). Said holding rail (2; 32, 36, 37; 34, 64, 65; 34, 64', 76; 79; 80) has a metal holding segment (3; 38; 54; 69, 77; 87; 88) for holding or supporting a front face area or a partial front face area of the glass closure (20) or individual glass elements or glass profile elements (21, 21') at least one projecting metal flange section (4, 5; 4', 5'; 49, 50; 57, 58; 71, 72; 81, 82) for laterally guiding or supporting the glass closure (20) and/or one, several or all the individual glass elements or glass profile elements (21, 21') thereof, whereby the flange segment (4, 5; 4', 5'; 49, 50; 57, 58; 71, 72; 81, 82) and the holding segment (3; 38; 54; 69, 77; 87; 88) are fixedly connected to one another by means of a heat-insulating and/or thermally separating connecting device (6, 7; 40, 41; 43, 44; 45, 46, 47, 48; 67, 68; 64, 65). The invention also relates to a holding rail that can be used in said holding device.

19 Claims, 7 Drawing Sheets

HOLDING RAIL FOR HOLDING GLASS PROFILE ELEMENTS

BACKGROUND OF THE INVENTION

The present invention concerns a device for retaining a glass fenestration composed of separate glass structural-section components, especially glass U-section components, or of other longitudinal, especially insulating, glass components. The invention also concerns a retaining rail that can be employed in such a retaining device.

Glass fenestrations composed of longitudinal glass components, glass structural-section components for example, are often employed for the large-area glazing of such buildings as gymnasiums, factories, free-standing staircases, houses, and commercial structures. The fenestrations are often secured by metal structural section in the opening that is to be fenestrated. Especially when a fenestration is insulating, as in the case of a hollow glass structural-section brick for example, water will at the current state of the art occasionally condense inside it and be almost impossible to remove.

SUMMARY OF THE INVENTION

The object of the present invention is to effectively prevent such condensation within a glass fenestration.

The device for retaining a glass fenestration composed of separate glass structural-section components, especially glass U-section components, or of other longitudinal, especially insulating, glass components is accordingly characterized by at least one retaining rail for retaining and bearing and for the lateral guidance and support of the individual longitudinal glass component, glass structural-section component, or glass fenestration, whereby the retaining rail is provided on the one hand with a retaining length of structural section of metal for retaining or supporting a face-side area or part of a face side area of the glass fenestration or one, more, or all of its glass components or glass structural-section components and on the other hand with at least one length of metal flange for the lateral guidance and support of the glass fenestration and/or of one, more or all of its individual glass components or glass structural-section components. Since the length of flange and the retaining section are fastened together by a heat-insulating and/or thermally separating connecting fixture, not only will a reliable bearing or retaining of the glass fenestration be ensured, but the lengths themselves, which are to individually retained, will be thermally separated. The face side areas, which the retaining rails comprise, will not be subject to the undesirable climatological effects of heat bridge-over. Surprisingly, this feature will in turn not only effectively prevent the accumulation of condensed water inside the glass fenestration and the penetration of water thereinto, but the retaining rail will also contribute to the fenestration's insulating effect due to the absence of heat bridging at its retainer.

Advantageous embodiments of the present invention are addressed in the subsidiary claims.

Glass fenestrations of glass structural-section components, especially glass U-section components, are known from Europe Patent 0742324A1, which specific reference will be made to in its entirety for further details as to the design of glass fenestrations. The glass structural U-section components of the glass fenestration known therefrom, however, are to be oriented vertical rather than horizontal. There are accordingly no problems with statics or with installation in a building. Problems do occur, however, when glass structural-section components are to be installed horizontal in that the lowermost component must support the weight of the ones above it.

A retaining device of the aforesaid genus is accordingly of advantage in horizontal glass fenestrations of horizontal glass structural-section components to secure each glass structural-section component individually and ensure that the lower components will need to support no more weight than the upper components do.

Another retaining device for retaining glass structural-components is known from German 29809177 U1, FIG. 4. This device features horizontal retainers mounted against a wall on bases. This device is accordingly appropriate only for fastening cladding in the form of glass structural-section components, components with L-shaped cross-sections, that is, to a wall, and not for retaining a glass fenestration in an opening in a building.

To ensure that the retaining device in accordance with the present invention provides simple means of securing the glass structural-section components at any desired height when fenestrating an opening in a building, the retaining device in one preferred embodiment is composed of glass structural-section components, especially glass U-section components, to be installed horizontal, whereby at least one retaining rail is installed vertical and designed to secure by tension and/or compression the glass structural-section component s that the glass structural-section components are retained by or rest against. This embodiment features a retaining section for securing by tension and/or compression, especially by way of hammerhead screws or of similar threaded fasteners, a metal structural-section securing section and at least one metal flat section for the lateral guidance or support of the glass structural-section components and/or the glass fenestration. The flat section and the securing section are fastened together by way of the heat-insulating and/or thermally separating connecting fixture.

The vertical and appropriately cross-sectioned retaining rail allows the height of the glass structural-section component holder to be continuously varied. The same retaining device can accordingly retain various glass fenestrations with glass structural-section components of different heights. It is also possible to construct the particular glass fenestration being retained out of glass structural-section components of different widths, of different heights, that is, as installed. The securing section and the flange section are metal for reasons of appearance and/or stability. In particular when closing off openings in a building and in the case of parallel spaces created by glass structural-section components, such metal rails could lead to misting up of the glass structural-section components due to the condensation of water on the inner surfaces of the components. It has, surprisingly, been demonstrated that fabricating the metal sections and thermally insulating them will at least extensively eliminate such misting. Thermal insulation will also of course lead to better k's in the glass fenestration retained by the retaining device.

Further advantageous embodiments of the present invention are addressed in the subsidiary claims. A retaining rail for use in a retaining device in accordance with the present invention is the subject of the ancillary claim.

Since the connecting fixture is intended for thermally separating the securing section from the flange section, all metal heat bridging should be avoided. The connecting fixture should accordingly be of a poorly heat-conducting material. The retaining section or securing section must on the other hand be able to withstand to some extent considerable forces, necessitating a very strong connecting between the flange section and the retaining or securing section. The connecting fixture in one advantageous embodiment of the present invention accordingly comprises a double or triple web or at least two connecting webs of a poorly heat-conducting material, especially plastics-based, extending along the length of the retaining rail and separated from each other at a right angle to that length. The connecting fixture and preferably the double web or connecting webs will also preferably be of polyamide or with a core of polyamide. The advantage of polyamide is that it can be coated subsequently along with the metal sections in accordance with the desired surface of the overall retaining rail. The retaining rail, comprising the retaining section and at least one and preferably two flange sections can accordingly be fabricated and subsequently coated in accordance with the desired appearance of the visible areas. The flange section and/or the retaining section, the aforesaid securing section for instance, will in this event be aluminum.

The retaining section can be of tubing or of another type of structural section reinforced by two walls. When the retaining section is a securing section it will preferably be of C section to allow the head of a threaded fastener to easily engage its back. It will be of advantage when employing tensioning for security to employ heads that can be appropriately oriented for insertion through the gap in the C and rotated 90° to engage the section.

To guide both sides of the glass structural-section component and/or the glass fenestration, comprising for example two lengths of glass structural section with their webs together, composed thereof, and in particular to retain it in the building opening that is to be fenestrated, one preferred embodiment includes two flange sections that extend along both sides of the retaining section, each connected to it by a connecting fixture.

To fasten the metal sections of the retaining rail securely together, it will also be preferable for the connection between the connecting fixture and the particular metal section to be established by engagement of the other side of the hooked edge of an accommodating groove in one of the components involved in the connection by an appropriately cross-sectioned head or end on the other component. It will be preferable in this case for every connecting web in the ends facing the metal section to be more or less T-shaped or otherwise thicker to provide rear engagement for an appropriate C-sectional accommodating groove for each connecting web in the section being connected.

It will also be preferable for the embodiment of the retaining device in accordance with the present invention employed for horizontal glass fenestrations to provide at least one glass structural-section component holder for each glass structural-section component or pair of glass structural-section components to be secured. It will be preferable to provide a retaining device at both vertical edges of the building opening being fenestrated, so that each horizontal glass structural-section component can rest on a glass structural-section component holder at each end. Glass structural-section component holders for retaining the ends of glass structural-section components can preferably be tensioned and hence secured at any desired height by means of at least one threaded fastener, especially a hammerhead screw, each on the C cross-sectional securing section.

It may, now, happen that glass fenestrations of different thickness must be installed in accordance with the on-site situation. It has until now always been necessary to fabricate special structural section, which is really expensive. Retaining devices for particularly thick glass fenestrations, like TWD (transparent heat-insulated glass fenestration) fenestrations are because of their special fabrication, really expensive to manufacture. This problem is eliminated in accordance with a particularly advantageous embodiment of the retaining device in accordance with the present invention. In this advantageous embodiment of the present invention, the retaining device is adjusted to glass fenestrations of different thickness not by fabricating special structural section but by using longer or shorter connecting fixtures. The connecting fixtures are again as hereintofore specified preferably based on plastics and are readily available in various lengths. Depending on whether a shorter connecting fixture or a somewhat longer connecting fixture is employed to connect the flange section to the retaining section, the distance between these two sections will be longer or shorter. Flange, retaining, or securing sections of metal structural section can always be fabricated equal and stocked by the manufacturer. Depending on the builder's specific requirements or on the particular glass fenestration to be retained, the appropriate metal structural sections, i.e. retaining sections and flange sections, can be fastened together by connecting fixtures of appropriate length, e.g. longer or shorter double webs or multiple connecting webs. This particularly advantageous embodiment of the present invention accordingly ensures that the width of the retaining section will match the thickness of the glass fenestration being retained and that at least one matching connecting fixture can be selected from several of varying length.

Another particularly preferred embodiment of the present invention features a set of several retaining rails comprising an essentially U cross-sectional retaining rail designed for strictly lateral support with rectangular structural section as a retaining area adjacent to the face areas of the glass fenestration but with no supporting function, a T-sectional, H-sectional, or I-sectional retaining rail as a middle strut in a glass fenestration or to separate two glass fenestrations, and a lower, retaining rail that is provided on its lower surface, the surface facing away from the building's fenestration, with supporting components. These supporting components are themselves preferably supporting strips, of either simple straight section, I-sectional, or extending out in the form of vertical webs, that is, L-sectional, or T-sectional.

The retaining rail in accordance with the present invention, which is designed for use in a retaining device of the species hereintofore specified, is particularly characterized by a polygonally cross-sectional or, for the tensioned securing of glass structural-section component holders by means of hammerhead screws, C-sectional, retaining or securing section of metal, by at least one projecting flange of metal for the lateral guidance or support of glass structural-section components and/or the glass fenestration composed thereof on the side facing the glass fenestration that the glass structural-section component holder can optionally be applied to, and by a connecting fixture preferably comprising a double web or at least two connecting webs that fasten the two metal sections together thermally separate.

BRIEF DESCRIPTION OF THE DRAWINGS

Various embodiments of the present invention will now be specified with reference to the accompanying drawing, wherein.

DESCRIPTION OF THE PREFERRED EMBODIMENTS

Figure 1:
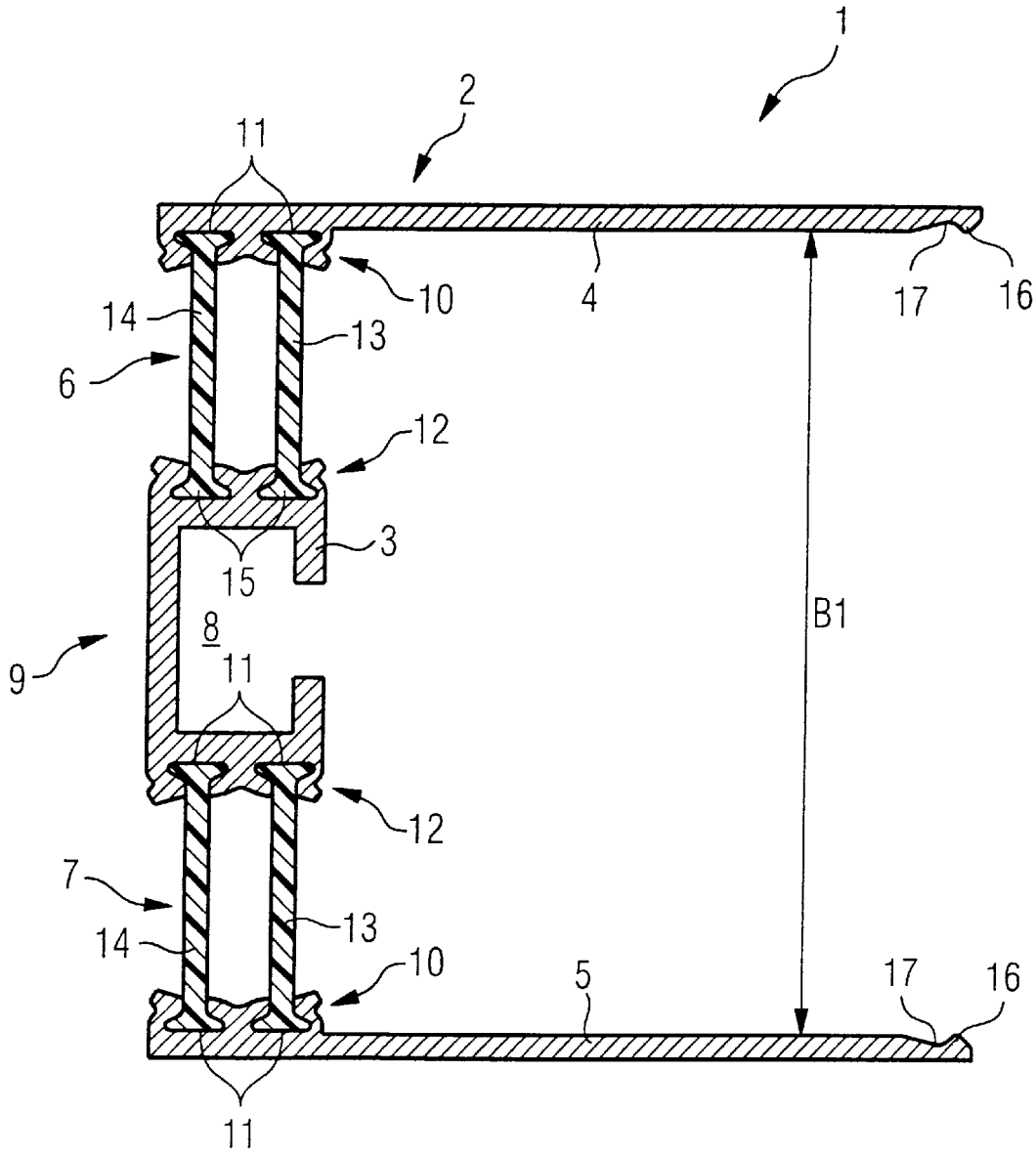
FIG. 1 is a horizontal section through a retaining rail in a retaining device for retaining glass fenestrations composed of horizontal glass structural-section components.

FIG. 1 is a horizontal section through part of a retaining device 1 for a glass building fenestration in the form of a retaining rail 2. Retaining rail 2 has more or less in the middle a retaining section, a length of C section, in the form of a securing section 3 and two lateral flange sections 4 and 5. Each flange section 4 and 5 is fastened to securing section 3 by a connecting fixture 6 and 7 respectively. The retaining rail 2 as a whole, with flange sections 4 and 5, connecting fixtures 6 and 7, and securing section 3, is in the form of a length of structural U section, with flange sections 4 and 5 constituting the flanges and connecting fixtures 6 and 7 and, between them, securing section 3 the web. The groove 8 constituted by the inside of C-shaped securing section 3 opens into the inside of the U-sectional retaining rail 2. The edges of flange sections 4 and 5 are in the same plane as the back 9 of retaining rail 2 opposite the flanges of the U section in retaining rail 2.

Each connecting area 10 is provided with two C-shaped marginate accommodating grooves 11. The sides of securing section 3 facing flange sections 4 and 5 are provided with matching connecting areas 12.

Each connecting fixture 6 and 7 is provided with a multiple web in the form of two connecting webs 13 and 14 (whereof, although the situation is not illustrated, there may be more than two). Each connecting web 13 and 14 is in the form of a length of I section, the flanges of the I being, to ensure precise fit in accommodating grooves 11, located at the terminating sections 15 facing the sections 3 through 5 being secured. The accommodation of I-shaped terminating sections 15 in grooves 11 provides connecting fixtures 6 and 7 with a solid attachment to both flange sections 4 and 5 and securing section 3. To further improve stability, the accommodating grooves 11 in each connecting area 10 and 12, and hence the connecting webs 13 and 14 accommodated therein, are a specific distance apart. Securing section 3 and flange sections 4 and 5 are metal, aluminum in the preferred embodiment illustrated. Connecting webs 13 and 14 are polyamide. The retaining rail 2 in some unillustrated embodiments is coated with plastic, powder, or a similar material.

The free end of each flange section 4 and 5 is provided with a hook-shaped structure 16 incorporating an inside groove 17 facing the interior of the U section that comprises the retaining rail.

The purpose of retaining rail 2 will now be specified with reference to FIGS. 2 through 6.

Figure 2:
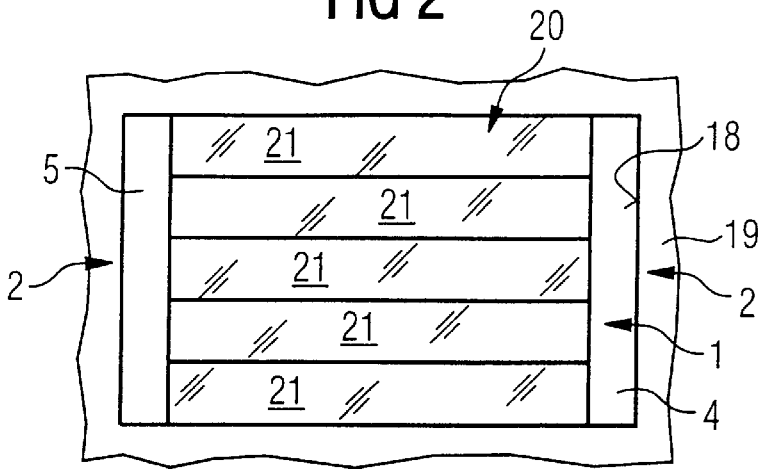
FIG. 2 is a frontal view of a glass fenestration retained by such a retaining device for closing an opening in a building.
Figure 3:
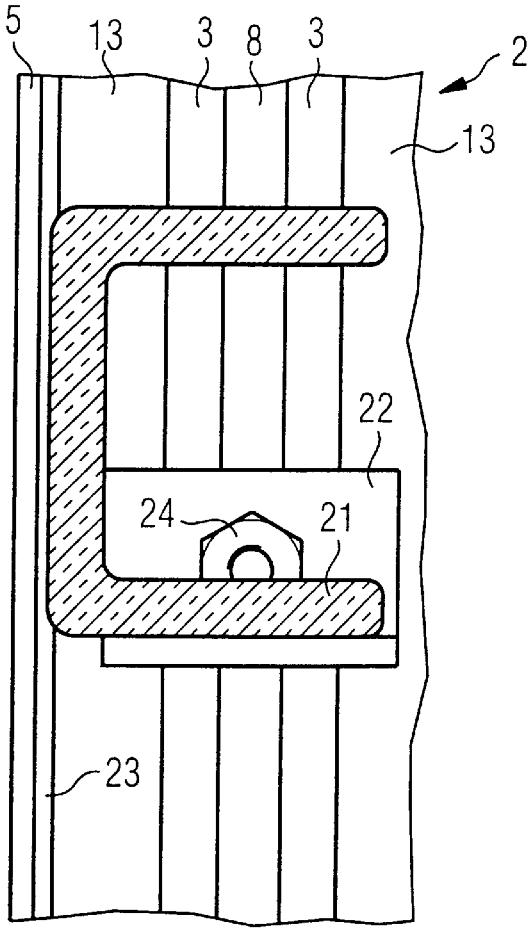
FIG. 3 is a view from the right side of FIG. 1 of an area of the retaining rail in FIG. 1 with a length of glass structural U section retained therein.
Figure 4:
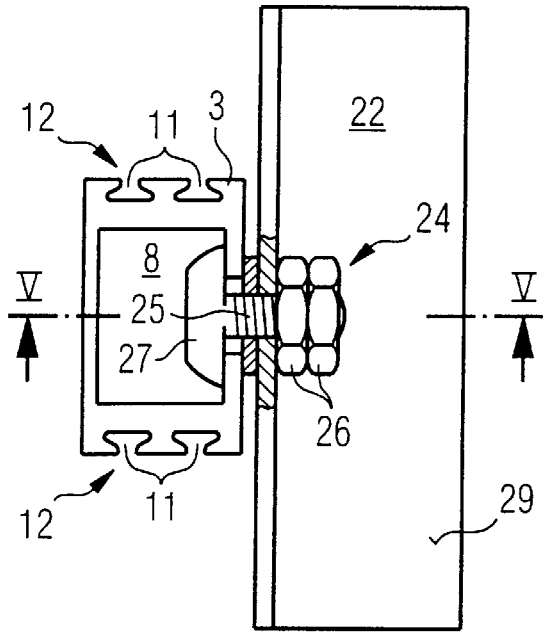
FIG. 4 is an overhead view of a securing section in a retaining rail comparable to the one in FIG. 1 with a glass structural-section component holder secured therein.
Figure 5:
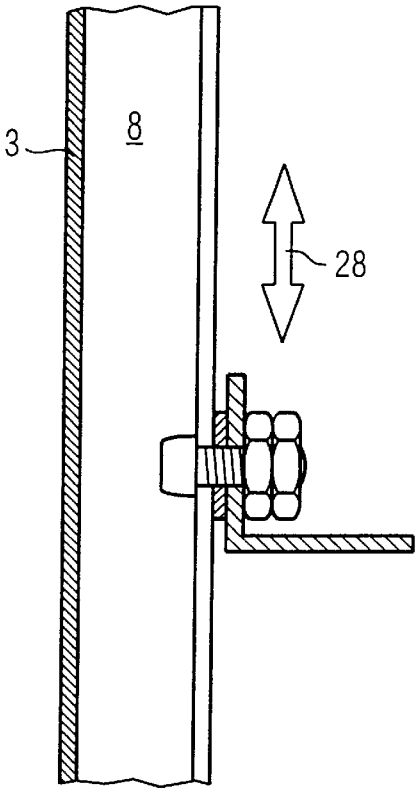
FIG. 5 is a sectional view along the line V—V in FIG. 4.

FIG. 2 is a frontal view of part of a wall 19 surrounding an unobstructed opening 18 in a structure, a building for example. Opening 18 is fenestrated by a glass fenestration 20. Glass fenestration 20 is composed of several longitudinal and horizontally disposed glass U-section components 21.

Since the longer glass structural-section components 21 are, the more considerable they can weigh, to eliminate rateable loads on the components, accordingly, they are retained at their ends in retaining rails 2 secured to the vertical soffit areas of opening 18. Since it is the retaining of an individual glass structural-section component 21 that is the object, it rests, as illustrated by way of example in FIG. 3, on a glass structural-section component holder 22 with the component's end accommodated in retaining rail 2 and supported at the side by a flange section 5. A sealing component 23 acts as a cushion between flange section 5 and glass structural-section component 21. Glass structural-section component holder 22 is retained against securing section 3 by a threaded fastener 24 provided with a lock nut. The head 27 of threaded fastener 24 engages the back of the edge of groove 8. The situation will now be specified with reference to FIGS. 4 and 5.

The threaded fastener 24 in the embodiment illustrated therein comprises a hammerhead screw 25 with matching nuts 26 that tension and secure screw 25 in groove 8 with head 27 at any desired height (28).

The glass structural-section component holder 22 is angled and has a supporting surface 29 for a single glass structural-section component 21.

Figure 6:
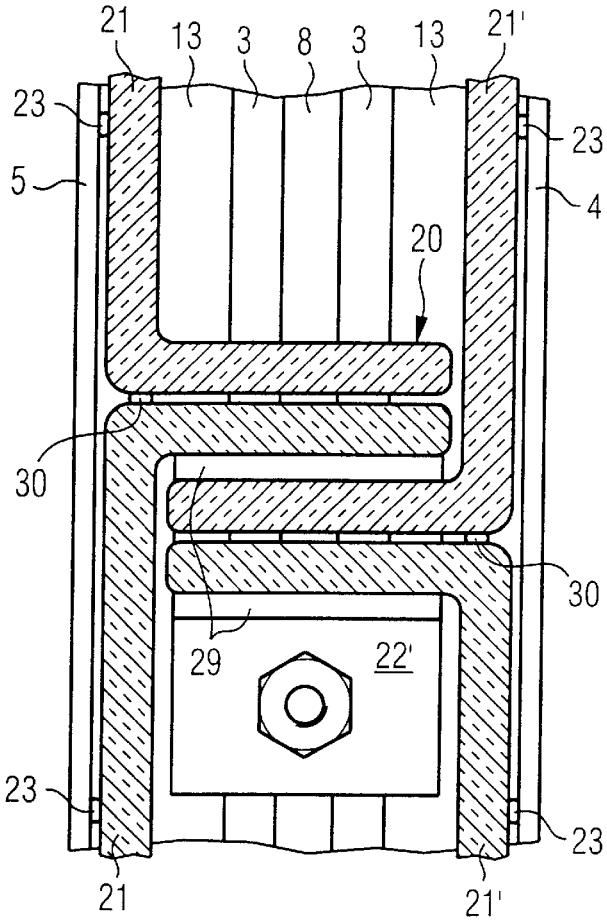
FIG. 6 is a view from the right side of FIG. 1 of an area of the retaining rail with an area of the glass fenestration retained therein comparable to the one in FIG. 2.

FIG. 6 illustrates another embodiment wherein a glass fenestration 20 composed of several interlocking glass structural-section components 21 and 21' each with its flanges facing those of the others can be retained at its individual components. The glass structural-section component holder 22' in this embodiment is essentially F-shaped in cross-section, whereby the resulting two supporting surfaces 29 each serve for bearing the upper flange of two mutually facing glass structural-section components 21 and 21'. The outward-facing webs of glass structural-section components 21 and 21' are both retained by flange sections 4 and 5, whereby here again sealing components 23 acting as cushions are accommodated in inside grooves 17. Although appropriate seals 30 are provided between the horizontally aligned glass structural-section components 21 and 21' sealing the hollow interior space 31 between them and preventing water vapor from escaping, the resulting double-walled glass fenestration is, in spite of its secure bearing in securing section 3 and the accordingly dictated thermal coupling thereto, very insensitive to misting up or condensed-water accumulation inside. The reason for this is that the connecting fixtures 6 and 7 constituted by connecting webs 13 and 14 ensure thermal uncoupling between the flange sections 4 and 5 that represent the wall of retaining device 1 and securing section 3.

Various aspects of the first embodiment of the retaining device hereintofore specified and of the retaining rail accommodated therein will now be summarized with reference to FIG. 1.

To provide a simple-to-produce and universally employable retainer for retaining a glass fenestration 20 comprising in particular horizontal glass structural-section components, specifically glass U-section components 21 and 21', whereby misting up of the glass structural-section components from inside will be impossible, a retaining device 1 is proposed with at least one vertical retaining rail 2 for the tensioned or compressed attachment of the glass structural-section component holders 22 and 22', on or by which the glass structural-section components 21 and 21' are retained or borne, whereby the retaining rail 2 features a projecting flange section 4 or 5 for the tensioned or compressed, especially by means of hammerhead screws 25 or similar threaded fasteners 24, attachment of a structural-section••sectional securing section 3 in the form of a retaining section and at least one flange section 4 for the lateral guidance or support of glass structural-section components 21 and 21' and/or glass fenestration 20. The flange section 4 or 5 and the retaining or securing section 3 are metal and are fastened together thermally separated from each other by a connecting fixture 6 or 8.

FIGS. 7 through 11 illustrate further retaining rails for retaining devices 35, 66, and 73 for glass fenestrations. These embodiments mainly include horizontal retaining rails that can easily be employed along with the laterally vertical retaining rails 2 in the first embodiment. The retaining rails illustrated in FIGS. 7 through 11, however, are also appropriate for retaining and supporting vertically mounted longitudinal glass components or glass structural-section components and glass fenestrations composed thereof. Further embodiments of the retaining device accordingly feature retaining rails of the species illustrated in FIGS. 7 through 11 along with for example, instead of the vertical retaining rails illustrated in FIG. 1, lateral retaining rails of the form illustrated as upper retaining rails 32, 33, and 34 in FIGS. 7, 8, and 9.

Figure 7:
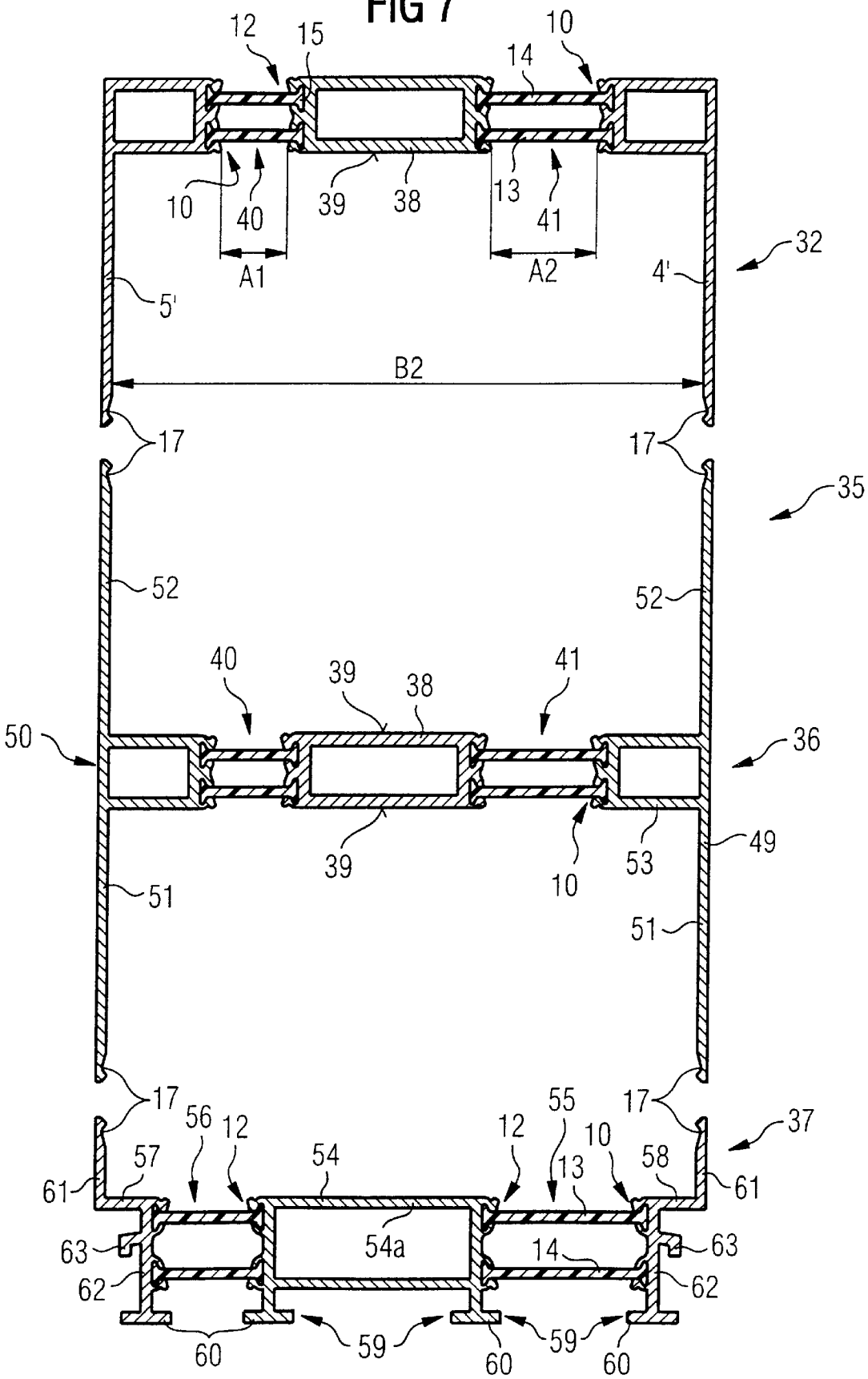
FIG. 7 is a cross-section through another embodiment of a retaining device for glass fenestrations with three horizontal retaining rails.

The second embodiment of a retaining device 35, the horizontal retaining rails 32, 36, and 37 whereof are illustrated in cross-section in FIG. 7, features an upper retaining rail 32, a middle retaining rail 36, and a lower retaining rail 37.

Upper retaining rail 32 is essentially similar to retaining rail 2 except that the securing section 3 employed as a retaining section 38 in retaining rail 2 is not C-sectional, the side facing the glass fenestration being continuous and without a gap. Retaining section 38 is accordingly on the whole essentially rectangular in cross-section, the side facing the glass fenestration being provided with a supporting surface 39 that can retain or support an unillustrated matching face-side area of the glass fenestration. The connecting fixtures 40 and 41 are comparable to connecting fixtures 6 and 7 although of different length, the distances A1 and A2 between flange section 5 and retaining section 38 or retaining rail 36 differ, in contrast to those apparent from FIG. 1. The connecting fixtures 40, 41, 6, 7 (FIG. 1), 8, or 40 and 44 (FIG. 9) 45 and 46, or 47 and 48 (FIGS. 10 and 11) accordingly allow the thicknesses B1, B2, B3, B4, and B5 between the individual flange sections to be adjusted to the particular glass fenestration or other structural conditions employed.

In order to accommodate glass fenestrations with particularly large faces, the flange sections 4' and 5' in upper retaining rail 32 are L-shaped, the shorter L-shaped web **4*a*' being rectangular and provided with connecting areas 10. Upper retaining rail 32 for example can be employed either as an upper guide for retaining the glass fenestration's upper face-side area inside the building opening (retaining section 38 taking no part in the support) or as lateral guides similar to the retaining rails 2 in FIG. 2** although applicable to vertical glass structural-section component glass fenestrations.

The middle retaining rail 36 in the illustrated embodiment is essentially H-shaped or I-shaped and features, in addition to the essentially rectangular cross-sectional retaining section 38, I-shaped cross-sectional flange sections 49 and 50, which are fastened to retaining section 38 by means of connecting fixtures 41 and 40. The I-shaped cross-section of flange sections 49 and 50 derives from the shape of flange sections 4' and 5' in that another flange 51 extends opposite flange 52. A rectangular cross-sectional and hence stronger web 53 extends halfway between flanges 51 and 52 with connecting area 10 at its free end.

Lower retaining rail 37 also features a retaining section 54 and two flange sections 57 and 58 secured to it by connecting fixtures 55 and 56 that are similar, with the exception of the distance between connecting webs 13 and 14, to connecting fixtures 41 and 40. Retaining section 54 has a rectangular cross-sectional section **54*a* with connecting areas 12 and supporting components 59. The supporting components 49 [sic] in lower retaining rail 37 consist of supporting strips 60** in the shape of upside-down T's.

Flange sections 57 and 58 are provided with an outward-bent flange 61 that extends around the lower face-side area of the glass fenestration and with a supporting wall 62 that is also provided at its free lower end with supporting components 59 in the form of supporting strips 60. Supporting wall 62 is provided on the side facing retaining section 54 with a connecting area 10. On the opposite side, supporting wall 62 is provided with a more or less hook-shaped strip 63 for anchoring etc.

Figure 8:
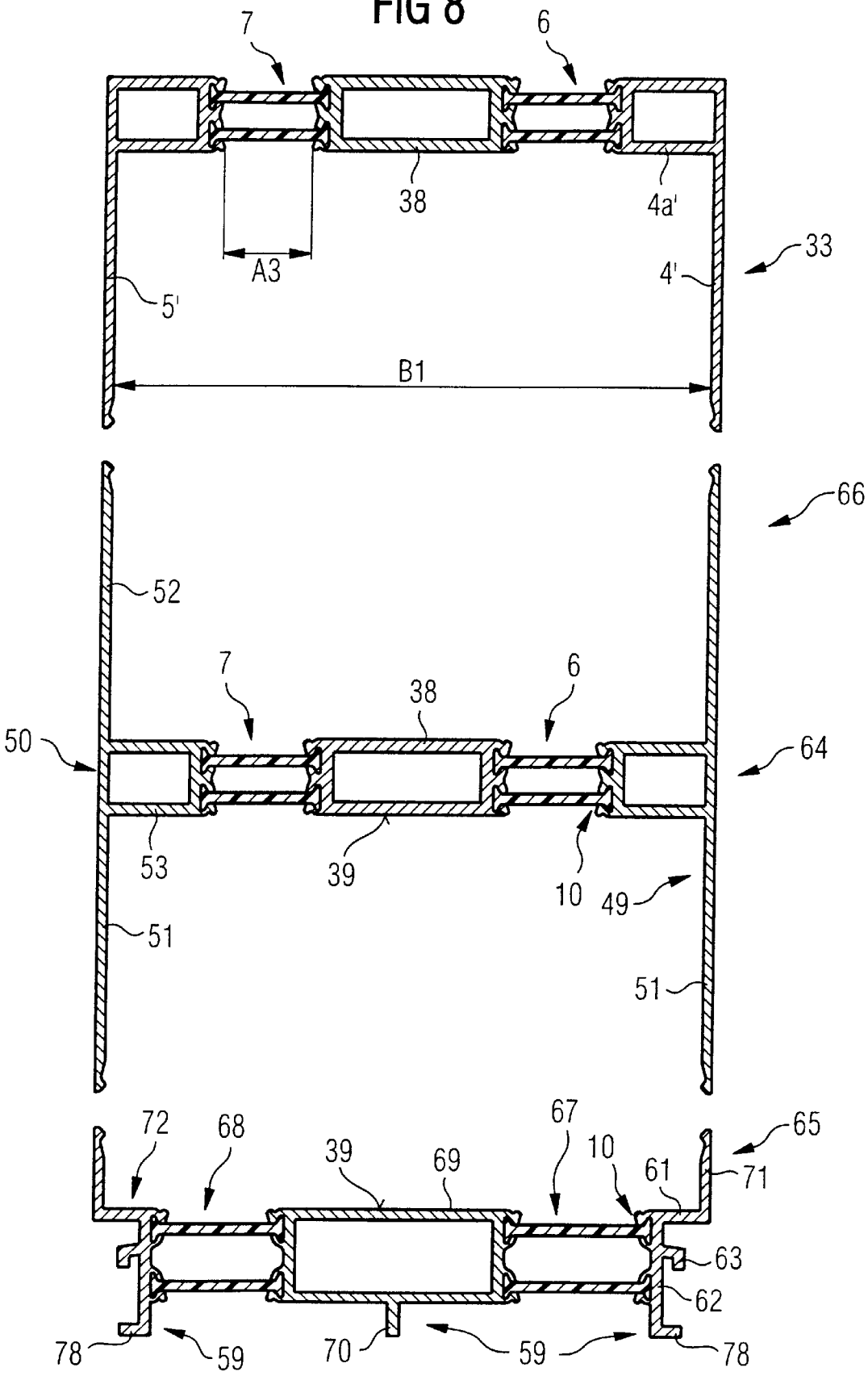
FIG. 8 is a view similar to that in FIG. 7 of a third embodiment of a retaining device with three retaining rails or lengths of retaining structural section that differs from the embodiment illustrated in FIG. 7 in width an with respect to a lower retaining rail.

The upper, middle, and lower retaining rails 33, 64, and 65 in the third embodiment of a retaining device 66 illustrated in FIG. 8 differ from the retaining rails 32, 36, and 37 illustrated in FIG. 7 in the length of connecting fixtures 6 and 7. This embodiment is accordingly provided with additional connecting fixtures 67 and 68. Connecting fixtures 67 and 68 differ from the connecting fixtures 55 and 56 in the second embodiment in that they have the same length A3 as connecting fixtures 6 and 7. Flange sections 4' and 5' and 49 and 50 and the retaining sections 38 in upper retaining rail 33 and middle retaining rail 64 illustrated in FIG. 8 are similar to upper and middle rails 32 and 36 in the retaining device 35 illustrated in FIG. 7. Lower retaining rail 65 also corresponds essentially, except with respect to its supporting components 59, to the lower retaining rail 37 illustrated in FIG. 7. Thus, retaining section 69 is provided on its lower side with a supporting component 59 in the middle in the form of a web 70 that extends straight down. Flange sections 71 and 72 have supporting components in the form of L cross-sectional supporting strips, although they are otherwise similar to flange sections 58 and 57.

Figure 9:
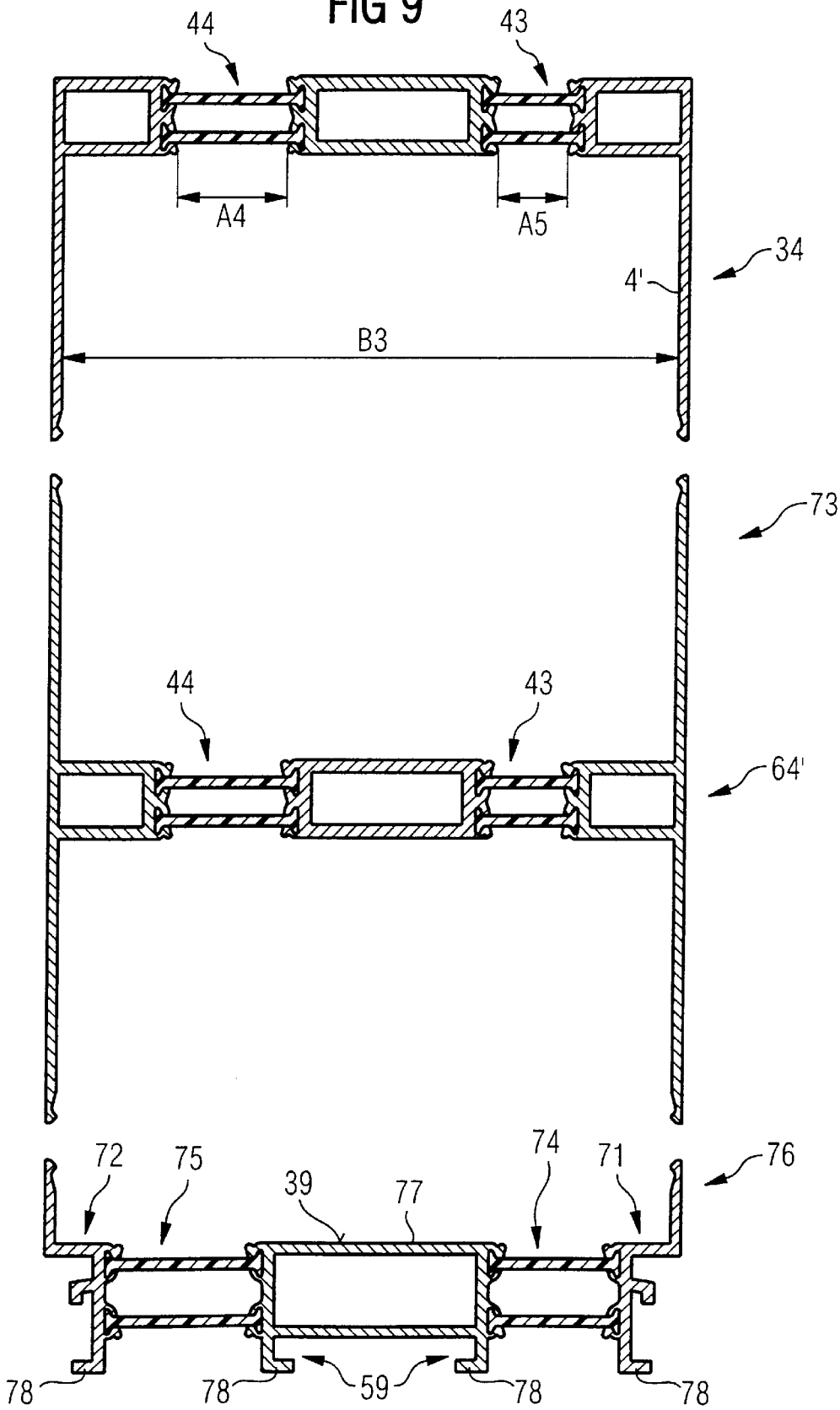
FIG. 9 is a cross-section similar to the ones illustrated in the previous two figures of a fourth embodiment of a retaining device with a retaining rail that again differs in width and wherein the lower retaining rail is further modified.
Figure 10:
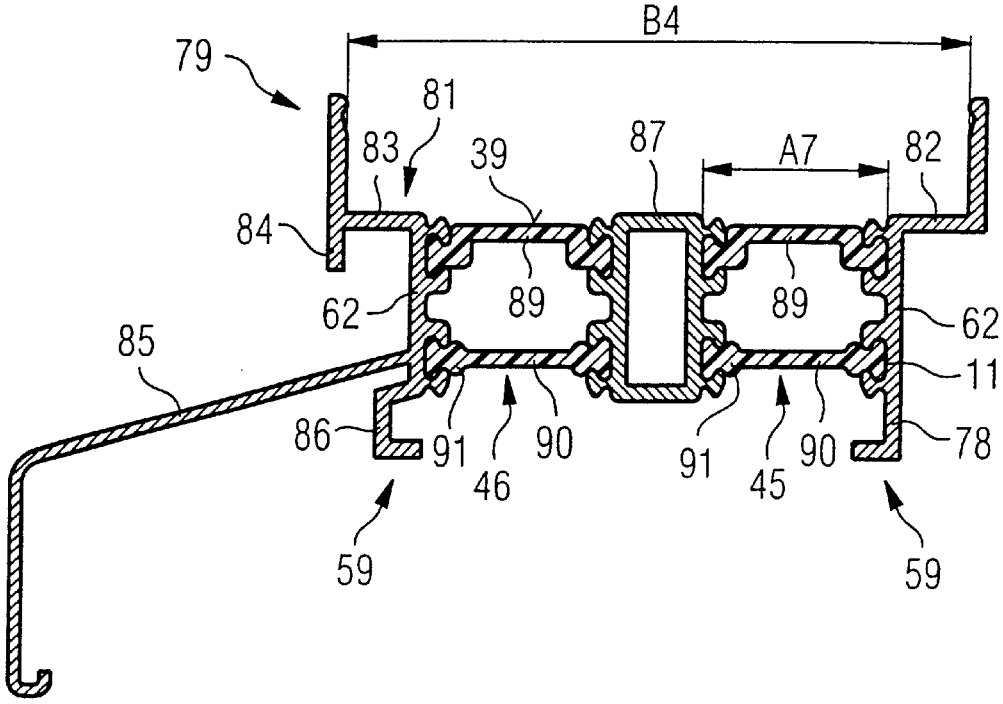
FIGS. 10 and 11 are cross-sectional views of two further embodiments of lower retaining rails comparable to the lower retaining rails illustrated in FIGS. 7 through 9.
Figure 11:
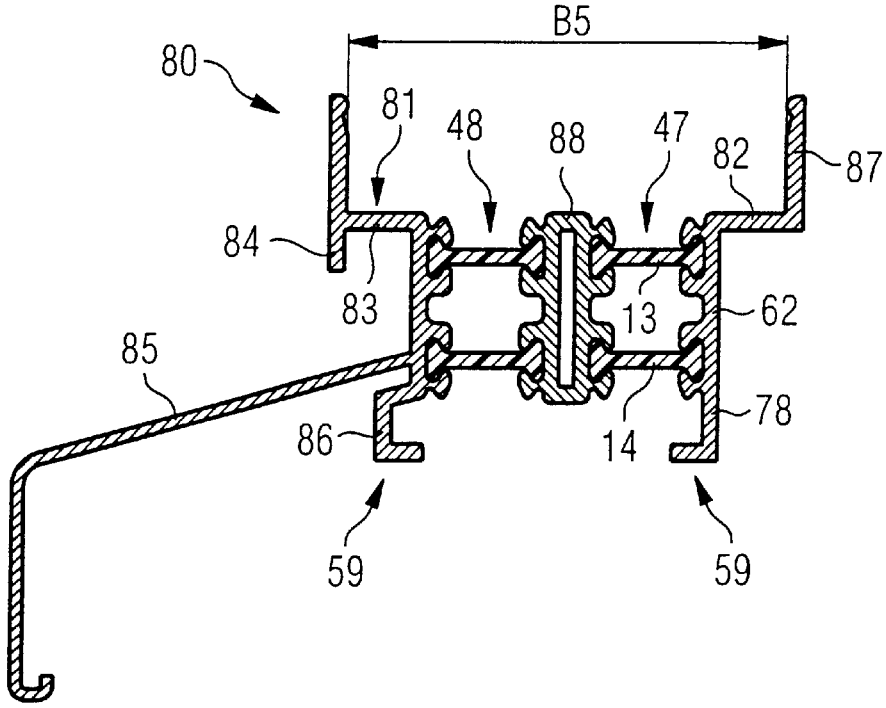

The fourth embodiment of a retaining device 73, illustrated in FIG. 9, is also mainly similar to the hereintofore specified embodiments 35 and 66, although its connecting fixtures 43 & 44 and 74 & 75, the last on lower retaining rail 76, differ in length. The supporting components 59 in both the flange sections 71 and 72 of lower retaining rail 76 and of the retaining section 77 in lower retaining rail 76 are in the form of L cross-sectional supporting strips 78. FIGS. 10 and 11 illustrate further embodiments of lower retaining rails 79 and 80 to be employed with glass fenestrations of shorter thicknesses B4 and B5 in building openings with more massive walls. Flange sections 81 and 82, in contrast to those in the hereintofore specified embodiments, are not entirely symmetrical. One flange section 81 features, in addition to a flange 83 that extends out at an angle and is in turn provided with a downward-extending strip 84, a windowsill area that extends out from supporting wall 62. The supporting component 59 in this flange section 81 is an almost U cross-sectional supporting strip 86. Flange section 82 features, in addition to a flange 87 that also extends out at an angle and to a supporting wall 62, a supporting component 59 in the form of an L-shaped supporting strip 78. The retaining sections 87 and 88 illustrated in FIGS. 10 and 11 on the other hand are different. Although retaining sections 87 and 88 are indeed essentially also rectangular in cross-section like the retaining sections 54, 69, and 77 in the embodiments illustrated in FIGS. 7 through 9, they are in this case higher than they are wide, allowing them to function with lesser thicknesses B4 and B5. Different thicknesses can also be further compensated by means of connecting fixtures 46 through 48 of different length. In this event, the retaining section 87 illustrated in FIG. 10 is even wider than the retaining section 88 in FIG. 11. Because of the in this case shorter distance that must be spanned between supporting components 69 and flange sections 81 and 82, there is no need for any supporting components 59 on retaining sections 87 and 88. Embodiments similar to those in FIGS. 10 and 11 but employing retaining sections with supporting components are of course also conceivable.

Whereas the connecting fixtures 47 and 48 illustrated in FIG. 11 consist, like those in the hereintofore specified embodiments, of two straight connecting webs 13 and 14, the connecting webs 89 and 90 in the connecting fixtures 45 and 46 illustrated in FIG. 10 differ essentially from connecting webs 13 and 14. Upper connecting fixture 89 is, in order to enlarge the supporting surface 39 for the face side of the glass fenestration, either displaced upward at an angle or cropped, whereas lower connecting web 90 features not only a thicker T-shaped head for engaging the back of accommodating groove 11 but grooves in a thicker head 91 or end.

Further embodiments of retaining devices in accordance with the present invention can be obtained by combining the features described with reference to FIGS. 1 through 11 as desired.

List of Parts

1. retaining device
2. retaining rail
3. securing section (retaining section)
4. flange section
4'. L-shaped flat section
**4*a*'**. reinforced short web
5. flange section
5'. L-shaped length of flange
6. connecting fixture
7. connecting fixture
8. groove
9. back
10. connecting area
11. accommodating groove
12. connecting area
13. connecting web
14. connecting web
15. terminating section
16. hook-shaped structure
17. inside groove
18. opening
19. wall
20. glass fenestration
21. glass structural-section component
22, 22'. glass structural-section component holder
23. sealing component
24. threaded fastener
25. hammerhead screw
26. nuts
27. head
28. adjustable height
29. supporting surface
30. seals
31. Interior space
32. upper retaining rail
33. upper retaining rail
34. upper retaining rail
35. retaining device, second embodiment
36. middle retaining rail
37. lower retaining rail
38. retaining section
39. supporting surface
40. connecting fixture
41. connecting fixture
42. connecting fixture
43. connecting fixture
44. connecting fixture
45. connecting fixture
46. connecting fixture
47. connecting fixture
48. connecting fixture
49. T-shaped flange section
50. T-shaped flange section
51. additional second flange
52. first flange
53. web
54. retaining section
55. connecting fixture
56. connecting fixture
57. flange section
58. flange section
59. supporting component
60. supporting strip
61. angled flange
62. supporting wall
63. hook-shaped strip
64. middle retaining rail
64'. middle retaining rail (fourth embodiment)
65. lower retaining rail
66. retaining device, third embodiment
67. connecting fixture
68. connecting fixture
69. retaining section
70. web
71. flange section
72. flange section
73. retaining device, fourth embodiment
74. connecting fixture
75. connecting fixture
76. lower retaining rail
77. retaining section
78. L-shaped supporting strip
79. lower retaining rail
80. lower retaining rail

81. flange section
82. flange section
83. angularly projecting flange
84. strip
85. windowsill area
86. more or less U cross-sectional supporting strip
87. retaining section
88. retaining section
89. connecting web
90. connecting web
91. thicker head
A1–A7. differing distances
B1–B5. differing inside thicknesses

What is claimed is:

1. A device for retaining a glass fenestration comprising individual glass longitudinal U-section components in form of insulating, glass elements; at least one retaining rail for lateral guidance and support of said individual longitudinal glass components; said retaining rail having a metal retaining section for retaining at least one face-side area of the glass fenestration; two projecting metal flange sections for lateral guidance of at least one component of the glass fenestration; said flange sections and said retaining section being fastened together by a thermally insulating connecting fixture; a plurality of said glass longitudinal U-section components being arranged in parallel adjacent to each other with ends of said components supported by said retaining rail in a channel of said retaining rail, said channel being formed by said two flange sections on each outer side, said channel having an inner part between said flanges and connecting elements formed from thermally insulating material, said inner part being insulated from said flange sections and supporting said glass elements, said thermally insulating material preventing condensation of water within a hollow space between two opposing glass elements.

2. The device as defined in claim 1 for retaining glass fenestrations wherein said at least one retaining rail is vertical and secures glass structural-section component holders retaining said glass U-section components; said retaining section having screw fastening means for securing a metal structural section securing section and said metal flange section, said flange section and said securing section being fastened together by a heat-insulating or thermally separating connecting fixture.

3. The device as defined in claim 1, wherein said connecting fixture has at least two mutually adjacent connecting webs of poorly heat-conducting material based on plastics paralleling said retaining rail.

4. The device as defined in claim 1, wherein said connecting fixture and a double web are of polyamide and are coated.

5. The device as defined in claim 1, wherein said flange section and said retaining section comprises a length of aluminum structural section.

6. The device as defined in claim 1, wherein said retaining section has a substantially rectangular cross-section with outer supporting components.

7. The device as defined in claim 1, wherein said two flange sections provide lateral guidance of said glass U-section components.

8. The device as defined in claim 7, wherein said retaining rail has a U-shaped cross-section enclosing face-side areas of the fenestration, said two flange sections comprising sides of said U-shape, said U-shape having a base comprising said retaining and securing sections connected on both sides to said flange sections by said connecting fixtures.

9. The device as defined in claim 1, wherein a connection between said connecting fixture and a metal section and a flange section is established by a shaped head of one component accommodated in a C-sectional accommodating groove and engaging a back of a hooked edge of said accommodating groove.

10. The device as defined in claim 9, including connecting means having webs with substantially T-sectional terminating sections for engaging said back of said C-sectional accommodating groove.

11. The device as defined in claim 2, wherein said glass structural-section component holders retain terminal areas of said glass structural-section components and are tensionable at any desired height to a C-sectional securing section and thereby secured by threaded screw means.

12. The device as defined in claim 1, wherein said retaining rail has a width adjusted to the glass fenestration being retained.

13. The device as defined in claim 1, wherein said retaining rail is U-shaped for horizontal installation with a retaining area in form of a length of rectangular structural section adjacent to face sides of the glass fenestration and fastened to a reinforced short web of L-sectional flange sections on both sides of a lateral support.

14. The device as defined in claim 1, wherein said retaining rail is installed transversely through a building opening to be fenestrated to support glass fenestrations installed on both sides, and comprises said retaining section for support, bearing, and security on both sides and fastened by a T-sectional flange section on one side by one connecting fixture.

15. The device as defined in claim 1, wherein said retaining rail is installed horizontal and having at least one flange section on a lower surface oriented facing down and away from the glass fenestration with at least one supporting strip comprising part of lengths of metal structural section.

16. The device as defined in claim 15, wherein said supporting strip is I-I-sectional and in form of a vertically downward projecting web.

17. The retaining rail in a retaining device as defined in claim 1, comprising a polygonal metal securing section having a rectangular cross-section for retaining one face-side area of the glass fenestration; at least one projecting metal flange section for lateral guidance of said glass structural-section components against a side for supporting said glass structural-section component holders, said connecting fixture comprising at least two connecting webs attaching the two metal flange sections thermally separated from each other.

18. The retaining rail as defined in claim 17, wherein said connecting webs are of low heat-conducting material of polyamide plastic.

19. A device for retaining a glass fenestration comprising individual glass longitudinal U-section components in form of insulating, glass elements; at least one retaining rail for lateral guidance and support of said individual longitudinal glass components; said retaining rail having a metal retaining section for retaining at least one face-side area of the glass fenestration; two projecting metal flange sections for lateral guidance of at least one component of the glass fenestration; said flange sections and said retaining section being fastened together by a thermally insulating connecting fixture; a plurality of said glass longitudinal U-section components being arranged in parallel adjacent to each other with ends of said components supported by said retaining rail in a channel of said retaining rail, said channel being formed by the two flange sections on each outer side, said channel having an inner part between said flanges and connecting elements formed from thermally insulating material, said inner part being insulated from said flange sections and supporting said glass elements, said thermally insulating material preventing condensation of water within a hollow space between two opposing glass elements; said at least one retaining rail being vertical and securing glass structural-section component holders retaining said glass U-section components; said retaining section having screw fastening means for securing a metal structural section securing section and said metal flange section, said flange section and said securing section being fastened together by a heat-insulating or thermally separating connecting fixture; said connecting fixture having at least two mutually adjacent connecting webs of poorly heat-conducting material based on plastics paralleling said retaining rail, said connecting fixture and a double web being of polyamide and are coated, said flange section and said retaining section comprising a length of aluminum structural section, said retaining section having a substantially rectangular cross-section with outer supporting components, said two flange sections providing lateral guidance of said glass U-section components, said retaining rail having a U-shaped cross-section enclosing face-side areas of the fenestration, said two flange sections comprising sides of said U-shape, said U-shape having a base comprising said retaining and securing sections connected on both sides to said flange sections by said connecting fixture, a connection between said connecting fixture and a metal section and a flange section being established by a shaped head of one component accommodated in a C-sectional accommodating groove and engaging a back of a hooked edge of said accommodating groove; connecting means having webs with substantially T-sectional terminating sections for engaging said back of said C-sectional accommodating groove, said glass structural-section component holders retaining terminal areas of said glass structural-section components and being tensionable at any desired height to a C-sectional securing section and thereby being secured by threaded screw means, said retaining rail having a width adjusted to the glass fenestration being retained, said retaining rail being U-shaped for horizontal installation with a retaining area in form of a length of rectangular structural section adjacent to face sides of the glass fenestration and fastened to a reinforced short web of L-sectional flange sections on both sides of a lateral support, said retaining rail being installed horizontally and having at least one flange section on a lower surface.

* * * * *